United States Patent [19]

Jones

[11] Patent Number: 4,832,370

[45] Date of Patent: May 23, 1989

[54] WIRE BINDING ELEMENTS

[75] Inventor: Leonard W. N. Jones, Hindhead, Great Britain

[73] Assignee: James Burn International Limited, United Kingdom

[21] Appl. No.: 175,038

[22] Filed: Mar. 29, 1988

[30] Foreign Application Priority Data

Apr. 2, 1987 [GB] United Kingdom ..... 8707843

[51] Int. Cl.[4] ..... B42B 5/12

[52] U.S. Cl. ..... 281/27.2; 412/39

[58] Field of Search ..... 281/21 R, 21 A, 25 R, 281/25 A, 28; 412/39

[56] References Cited

FOREIGN PATENT DOCUMENTS 1542471 10/1968 France ..... 412/39

*Primary Examiner*—Paul A. Bell

*Attorney, Agent, or Firm*—Wood, Herron & Evans

[57] ABSTRACT

A binding element for perforated sheets of the type comprising a length of wire bent so as to form curved prongs on which the sheets may be impaled, the wire being in the shape of a flat comb, the prongs of which are closed at their tips and opened at their bases or roots which are connected to their neighbors by aligned lengths of wire forming the stock or the spine of the comb, the strip being designed to be converted to a slotted tube by suitable bending of the prongs. In accordance with the invention the concave surface with part of each prong which is midway between its tip and root is formed with an indentation, which indentation assists the closing of the binding element very effectively and without any visible sign.

5 Claims, 1 Drawing Sheet

WIRE BINDING ELEMENTS

Figure 1:
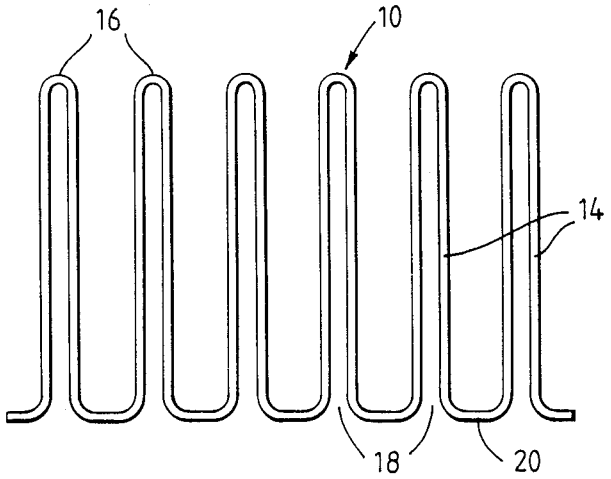

This invention relates to wire binding elements for perforated sheets and to the manufacture of such elements.

A known method of binding perforated sheets uses binding elements which are lengths of wire bent so as to form curved prongs on which the sheets are impaled. The element is provided, at the time of the impaling operation, in the form of a tube having a longitudinal slot in its wall and the final stage in the binding process is to close the slot by bringing the closed end of the prongs into their open ends.

Such elements are generally manufactured by firstly converting a length of wire to the so-called 'zig-zag' form, hereinafter referred to as a strip of zig-zagged wire of the kind set forth, in which the wire assumes the shape of a flat comb of indefinate length the prongs of which are 'closed' at their tips and 'open' at their bases or roots which are connected to their neighbours by aligned lengths of wire forming the stock or spine of the comb so that the pitch of the prongs corresponds to the pitch of the perforations in the sheet to be bound. A long length of such flat zigzag material is then brought to the slotted tube form, hereinafter referred to as a slotted tubular form as set forth herein, by suitable bending of the prongs.

Such binding elements have been provided with a 'nick' or indentation on the uppermost side of the prongs midway along their lengths. This is to facilitate the closing of the element in the final bending operation by dictating the fulcrum of the bend.

However, it has been found that the prongs have a tendency to bend, not at the 'nick' as expected, but rather, at a point a short distance away from the 'nick' around the curved prongs. This occurs especially in binding elements of larger pitches and wire diameters. Moreover, since the 'nick' is provided on the tension side of the element, it has a tendency to tear apart when the element is closed and become aesthetically unsightly especially when the element is formed from nylon coated wire. A further problem which has been found is that the 'nick' can provide an ingress point for corrosion.

A binding element in accordance with the present invention comprises a strip of zigzagged wire of the kind set forth, the strip being in the slotted tubular form as set forth herein and having an indentation on the concave surface of that part of each prong which is midway between its tip and root.

This arrangement has been found to assist the closing of the wire much more effectively since it results in the fulcrum of the bend always being in the same position as the indentation. A further advantage is that by positioning the 'nick' on the underside of the prongs it cannot be seen. Moreover, this side is in compression when the element is closed and therefore during the final binding operation the 'nick' also closes up rather than pulling open.

The indentation may be produced either by a forming operation or by a cutting operation.

One method of forming an indentation on the uppermost or convex side of the prongs after the strip of zigzagged wire has been converted to the slotted tube form is described in our U.S. Pat. No. 1251,807. A similar method may be used to produce an indentation on the concave side of the prongs. Alternatively the indentation may be produced when the zigzagged wire is in the unformed state.

Figure 2:
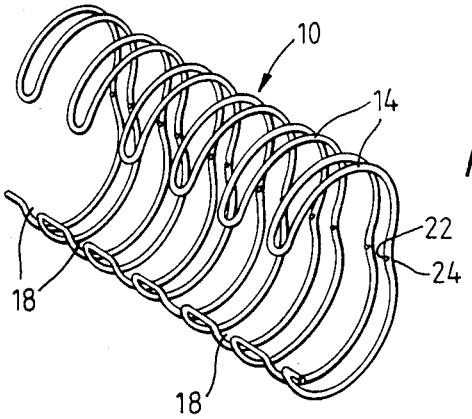
Figure 3:
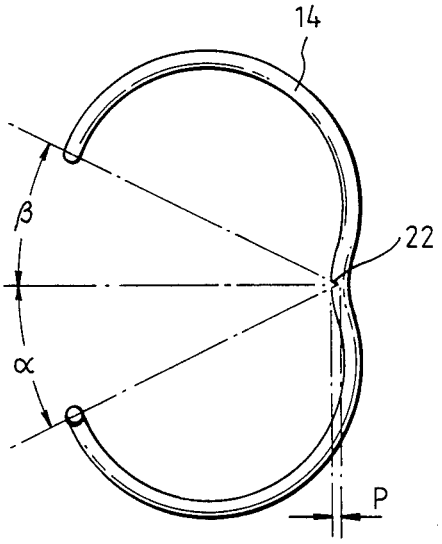

The invention will now be further described, by way of example, with reference to the accompanying drawings, in which:

FIG. 1 shows a length of zigzag wire forming part of a binding element of the type described, FIG. 2 shows a length of slotted tube formed from the wire element shown in FIG. 1, and FIG. 3 shows an end view of a binding element in accordance with the present invention.

The strip 10 shown in FIG. 1 is comb like, having prongs 14 closed at their tips 16 and open at their roots 18 where they are connected by lengths of wire 20. When the strip 10 has been converted to the slotted tubular form, it is in the condition illustrated in FIG. 2 with the prongs 14 curved so that perforated sheets can be impaled. That operation having been performed, the binding is completed by bringing the tips 16 of the prongs into their roots or open ends 18.

This final binding operation is greatly facilitated if the binding element is provided with an indentation 22 on the concave side of each prong 14 midway between its root and tip as shown in FIG. 3. The indentation dictates the position of the bend on closing the element thus ensuring that the final configuration of the element is a full round circle. In prior art binding elements where the indentation was provided on the uppermost side of the prongs, the prongs had a tendency to bend, not around the position defined by the indentation but around the weakest points on the curved wire, a short distance away from the indentation around the curved prongs.

It will be apprecited that the position of the indentation is such that the indentation is not readily seen and that on closing there will be no tendency for it to tear open; rather it will close up. Therefore, the indentation is extremely unlikely to provide an ingress point for corrosion.

The sides of the indentation make angles $\alpha$ and $\beta$ with axis x—x of the binding element. These angles are preferably equal to each other so that the indentation is symmetrical about the axis. Angle $\alpha$ (or $\beta$) is preferably between 45° about 55°.

The depth of the indentation, dimension P on FIG. 3, will obviously depend on the diameter of the wire from which the binding element is made. The maximum valve of P is preferably about 40% of the diameter of the wire.

As is described in our U.S. Pat. No. 1,251,807 the conversion of a strip zigzagged wire to the slotted tube condition may be effected by feeding the wire over an anvil in a step-by-step fashion and, while the strip is held stationary, clamping it so that the tips and roots of the prongs overhang the anvil. The overhanging portion of each prong is then struck with two or more hammers to cause it to conform to a shape determined by the anvil i.e. to the slotted tube configuration. The indentation may be produced in the last stage of such an operation by providing a projection on the anvil and a corresponding depression on the clamp. The indentation will then be formed as the binding element leaves the apparatus. A cutting operation could be employed instead i.e. to remove rather than to displace metal.

Alternatively a forming or cutting tool can be positioned before the slotted tube forming means so that the indentation is produced while the wire is still in the zigzagged condition. This has the advantage of aiding centralisation of the strip prior to the tube forming operation.

The tools used to produce the indentations should preferably be adjustable so that the depth of the indentation may be varied. Furthermore, the indentation may be cut or formed in different shapes but is preferably always symmetrical about the mirror axis of the prongs.

What I claim is:

1. A binding element for perforated sheets comprising a length of wire bent so as to form curved prongs on which the sheets may be impaled, the wire being in the shape of a flat comb, the prongs of which are closed at their tips and opened at their bases or roots which are connected to their neighbours by aligned lengths of wire forming the stock or the spine of the comb, the strip being designed to be converted to a slotted tube by suitable bending of the prongs characterised in that the concave surface of that part of each prong which is midway between its tip and root is formed with an indentation.

2. A binding element as claimed in claim 1 wherein the indentation on the prongs is formed prior to the wire element being converted to the open tube formation.

3. A binding element as claimed in claim 1 wherein the sides of the indentation are at an equal angle to with the main transverse axis of the binding element, so that the indentation is symmetrical about its axis.

4. A binding element as claimed in claim 3 wherein the angle lies between 45° and 50°.

5. A binding element as claimed in any one of the preceding claims wherein the depth of the indentation is about forty percent of the diameter of the wire.

* * * * *